US006218745B1

(12) United States Patent
Bodin et al.

(10) Patent No.: US 6,218,745 B1
(45) Date of Patent: Apr. 17, 2001

(54) APPARATUS FOR MAKING ELECTRICAL CONNECTIONS TO A DEVICE REQUIRING EMI PROTECTION

(75) Inventors: Joel J. Bodin, Chanhassen; Glen E. Monzo, Minneapolis, both of MN (US)

(73) Assignee: Honeywell Inc., Morristown, NJ (US)

( * ) Notice: Subject to any disclaimer, the term of this patent is extended or adjusted under 35 U.S.C. 154(b) by 0 days.

(21) Appl. No.: 09/268,425

(22) Filed: Mar. 12, 1999

(51) Int. Cl.[7] ..... H01R 13/648
(52) U.S. Cl. ..... 307/104; 361/816; 361/818
(58) Field of Search ..... 307/104; 318/492; 336/30, 92, 98; 361/139, 816, 818

(56) References Cited

U.S. PATENT DOCUMENTS 4,601,527 * 7/1986 Lemke ..... 339/14 R
5,186,635 * 2/1993 Pechulis et al. ..... 439/89
5,842,888 * 12/1998 Belopolsky ..... 439/620

* cited by examiner

*Primary Examiner*—Fritz Fleming
(74) *Attorney, Agent, or Firm*—Kris T. Fredrick

(57) ABSTRACT

A connector has conductive pins extending from outside the device to within the device and an electrically conductive wall surrounding a portion of the pins. The conductive wall abuts a printed wiring board containing EMI protective circuitry and contacts a ground plane within the printed wiring board. A selected pin is brazed to the connector and holds the printed wiring board in compression to assure a low impedance connection to the ground plane.

11 Claims, 2 Drawing Sheets

APPARATUS FOR MAKING ELECTRICAL CONNECTIONS TO A DEVICE REQUIRING EMI PROTECTION

CROSS REFERENCE TO RELATED APPLICATIONS (IF ANY)

Not applicable.

U.S. GOVERNMENT RIGHTS (IF ANY)

Not applicable.

BACKGROUND OF THE INVENTION

Field of the Invention

The present invention relates generally to the control of electromagnetic interference (EMI) and specifically to an apparatus for making electrical connection to a device containing electronics requiring EMI protection. Electromagnetic interference is said to exist when unwanted voltages or currents are present so that they adversely affect the performance of a device or system. These voltages or currents may reach the victim circuit by conduction or by radiation. Electrical filters may be designed to offer little opposition to the passage of certain frequencies or direct current (dc) while blocking the passage of other frequencies. Filters play a significant role in the reduction of conducted interference. A metal barrier may be imposed between sources of electrical noise and their victims to reduce or eliminate the electrical interference due to radiated interference.

The present invention is described in the environment of a pressure sensor or pressure transducer application. However, it is to be understood that this is only an illustrative environment and the present invention applies to other applications as well.

A transducer transforms one form of energy into another form. For example, a transducer can covert the measure or value of some physical property such as pressure or temperature into a corresponding value of an electrical parameter such as voltage. Transducers typically include extensive electronics to reliably manipulate or process very low level electrical signals. Therefore, it is necessary to take precautions in the design to minimize the effects of EMI on the transducer electronics. Transducers, for example precision pressure transducers, are applied in a wide variety of industrial and other applications in which the associated wiring or cabling is routinely exposed to EMI from many sources. In the past, electrical filtering arrangements including electrical components provided on a separate board specifically designed to reduce EMI have been employed in pressure transducers. In the past, EMI shielding of the EMI board circuitry has been provided by using additional parts for shielding. The extra parts add both piece part and labor costs. Thus, there is a need for an improved apparatus for making electrical connections to a device containing electronics requiring EMI protection.

BRIEF SUMMARY OF THE INVENTION

The present invention solves these and other needs by providing an apparatus for making electrical connections to a device requiring EMI protection. The apparatus includes a connector having conductive pins extending from outside the device to within the device and an electrically conductive wall surrounding a portion of the pins. A printed wiring board includes EMI protective circuitry and a ground plane. The conductive wall abuts the circuit board making electrical contact with the ground plane and forming a cavity of conductive material.

In another aspect of the present invention a selected pin is brazed to the connector and secured to the printed wiring board so that the printed wiring board is in compression. the compressive force holds the printed wiring board against the connector wall assuring a low impedance connection.

DETAILED DESCRIPTION OF THE INVENTION

Figure 1:
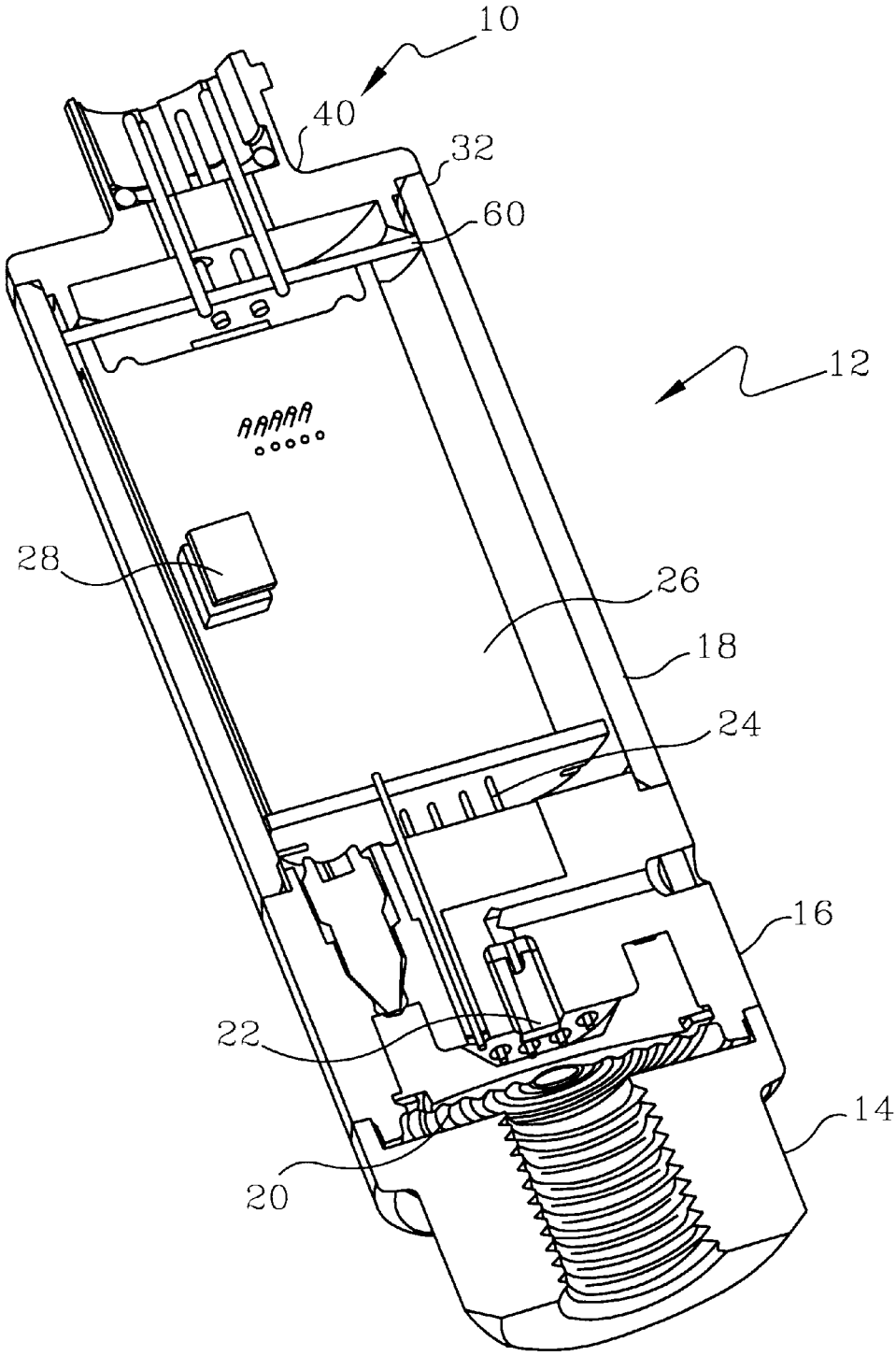
FIG. 1 shows a cross sectional perspective view of the present invention applied to a pressure sensing device with portions of the pressure sensing device also being shown.
Figure 2:
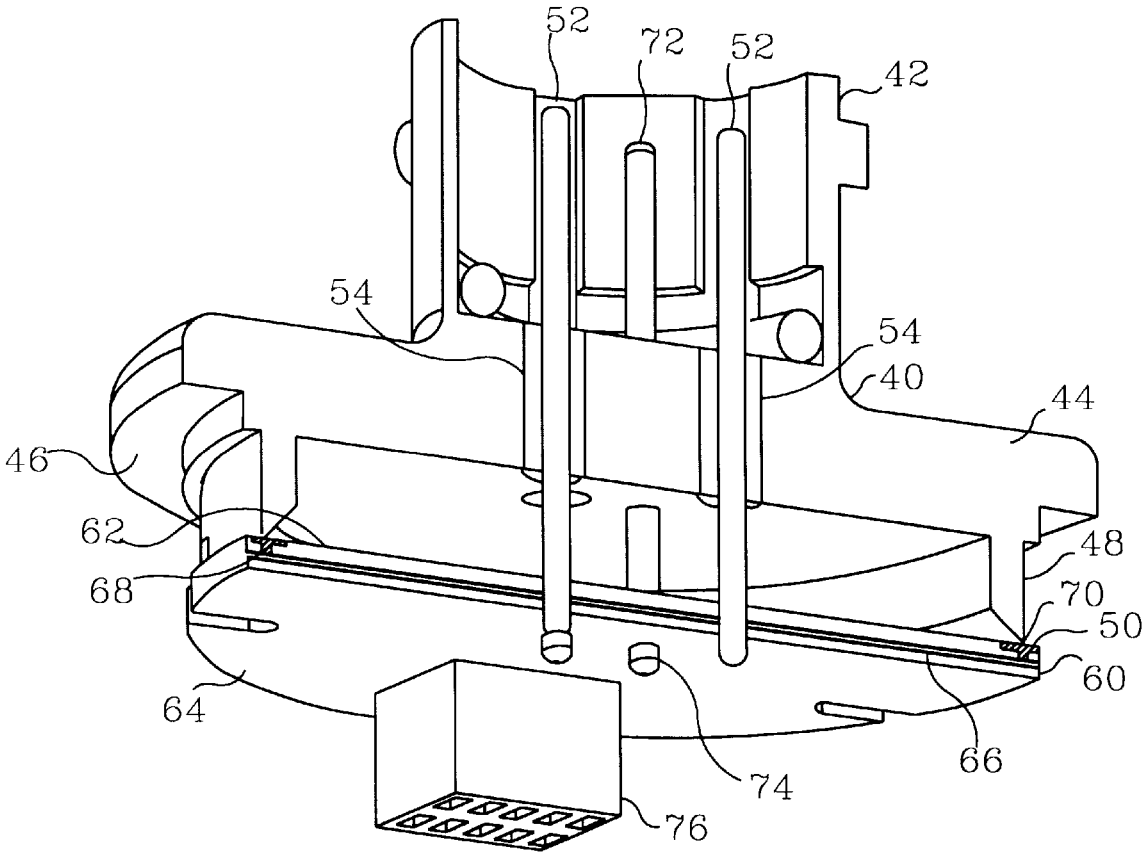
FIG. 2 shows an enlarged cross sectional perspective view of the present invention.

An apparatus for making electrical connections to a device containing electronics requiring EMI protection is shown in the drawings and generally designated 10. FIG. 1 shows a pressure sensing device or pressure transducer assembly 12 including pressure interface 14, sensor header 16, housing 18 and apparatus 10. Sensor header 16 includes diaphragm 20, sensor die 22 and conductive pins 24 which provide for communication between sensor die 22 and electronics located within housing 18. Housing 18 contains electronics such as printed wiring board 26 and connector 28 for communication between board 26 and a board that is not shown. Pressure interface 14, sensor header 16, housing 18 and apparatus 10 are joined together by welding. Apparatus 10 includes a connector body 40 which has an outwardly extending connector coupling arrangement 42 such as the 6 pin military connector type that is shown. Connector body 40 includes a generally planar portion 44 which has a shoulder 46 for being received on end 32 of housing 18. Connector body 40 further includes a downwardly extending wall or shell 48 which in the preferred embodiment is shaped or beveled so that it presents a small surface or a sharp edge 50. Conductive pins 52 are accessible outside pressure transducer 12 and extend through glass insulators 54 located in planar portion 44. Apparatus 10 further includes an EMI board 60. The purpose of EMI board 60 is to provide electrical filtering of the power or signals that are coming into the electronics of pressure transducer 12 and of signals coming from pressure transducer 12. EMI board 60 has a surface 62 on which electrical filtering components (not shown) are typically mounted and a surface 64. EMI board 60 may be referred to herein as second printed wiring board 60. Components found on the EMI board 60 may include, for example, AVX transguards to protect against incoming transients (ESD, etc.), capacitors to filter out high frequency noise, both incoming and outgoing, and ferrite beads to act as high impedance to high frequency noise, both incoming and outgoing. EMI board 60 includes a low impedance shielding plane 66 which may also be referred to as an internal ground plane or chassis plane. Plane 66 is brought to surface 62 by equally spaced vias 68. At surface 62 a circumferential conductive surface 70 is provided.

In the preferred embodiment pin 72, is not insulated from connector body 40, but rather is brazed to connector body 40 and is therefore at the potential of connector body 40. In the manufacturing process, EMI board 60 is located as shown and a tool is used to apply a force to surface 64 of EMI board 60 so that it is deflected toward connector body 40. While EMI board 60 is in this compressed position, pin 72 is soldered to EMI board 60 at 74 to take the stress of the compression once the force is removed. When the tool is removed, pin 72 will continue to hold EMI board 60 in compression so that a low impedance connection between edge 50 of wall 48 and circumferential conductive surface 70 is assured, through all environmental changes such as temperature variations. Electrical circuitry on EMI board 60 is connected through connector 76 to electronics located in housing 18.

In the present invention, having the internal EMI ground plane 66 attached to the chassis at both the chassis pin 72 and the entire circumference of the EMI board allows the ground plane 66 to be both very low impedance and low inductance. The low impedance and low inductance ground connection at circumferential conductive surface 70 allows the capacitors to more effectively filter out the incoming (coupled into the cabling) and outgoing (generated by the electronics) high frequency signals. In addition, the ground plane and the connection at the circumference of the EMI board acts like a faraday cage, eliminating possible internally-radiated high frequency signals from going further in the housing. A significant benefit from the invention is the very low impedance and low inductance chassis connection.

The present invention has been described in the environment of a ruggedized pressure transducer where the material used for connector body 40 is stainless steel and it is of single piece construction. In other environments other materials and construction may be used. Means other than the use of pin 72 to hold printed wiring board 60 in compression may be used. For example, a threaded type of fastener could be used.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparatus for making electrical connections to a device containing electronics requiring EMI protection, said apparatus comprising:

a connector having conductive pins extending from outside said device to within said device, said connector having an electrically conductive wall surrounding a portion of said pins within said device;

a printed wiring board comprising EMI protective circuitry and having an internal ground plane;

said conductive wall abutting said printed wiring board and making electrical contact with said ground plane, with selected ones of said pins connected to said EMI protective circuitry and with said wall and said ground plane forming a cavity of conductive material; and means for connecting said electronics requiring EMI protection to said printed wiring board.

2. Apparatus of claim 1 wherein said ground plane is electrically connected to a circumferential conductive surface on said printed wiring board and said apparatus further comprises means for forcibly maintaining said conductive surface against said wall to assure a low impedance connection.

3. Apparatus of claim 2 wherein said means for forcibly maintaining comprises a conductive pin having a first end embedded in said connector and a second end secured to said printed wiring board with said pin exerting compressive force to hold said circumferential conductive surface against said wall.

4. Apparatus of claim 3 wherein said wall terminates in an end having a shape that will bite into said conductive surface to form a low impedance connection.

5. Apparatus of claim 1 wherein said device is a pressure sensing device having a metal housing surrounding said electronics and having an end shaped for complementary receipt of said apparatus.

6. Apparatus for making electrical connections to a device containing electronics requiring EMI protection, said apparatus comprising:

a connector having conductive pins extending from outside said device to within said device, said connector having an electrically conductive shell extending within said device and surrounding a portion of said pins within said device, said shell terminating in an end;

a printed wiring board comprising EMI protective circuitry and having an internal ground plane;

a conductive surface on said printed wiring board facing said end, said conductive surface connected to said ground plane;

said conductive shell abutting said circuit board and making electrical contact with said conductive surface, with selected ones of said pins connected to said EMI protective circuitry and with said wall and said ground plane forming a cavity of conductive material;

a selected one of said conductive pins having a first end embedded in said conductor and having a second end secured to said printed wiring board with said pin exerting compressive force to hold said conductive surface against said shell; and means for connecting said electronics requiring EMI protection to said printed wiring board.

7. Apparatus of claim 6 wherein said end of said shell is shaped to provide a low impedance connection to said conduction surface.

8. In a pressure sensing device having a sensor header, electronics surrounded by a metallic housing, EMI protective circuitry, and a connector for making electrical connections to said device, the improvement comprising;

said connector having conductive pins extending from outside said device to within said device, said connector having an electrically conductive wall surrounding a portion of said pins within said device;

a printed wiring board comprising said EMI protective circuitry and having internal ground plane;

said conductive wall abutting said printed wiring board and making electrical contact with said ground plane, with selected ones of said pins connected to said EMI protective circuitry and with said wall and said ground plane forming a cavity of conductive material; and means for connecting said electronics to said printed wiring board.

9. The improvement of claim 8 wherein said ground plane is electrically connected to a circumferential conductive surface on said printed wiring board and said apparatus further comprises means for forcibly maintaining said conductive surface against said wall to assure a low impedance connection.

10. The improvement of claim 9 wherein said means for forcibly maintaining comprises a conductive pin having a first end embedded in said connector and a second end secured to said printed wiring board with said pin exerting compressive force to hold said circumferential conductive surface against said wall.

11. The improvement of claim 10 wherein said wall terminates in an end having a shape that will bite into said conductive surface to form a low impedance connection.

* * * * *